US006170402B1

(12) United States Patent
Rude et al.

(10) Patent No.: US 6,170,402 B1
(45) Date of Patent: Jan. 9, 2001

(54) ROLLER COASTER CONTROL SYSTEM

(75) Inventors: Gregory J. Rude; Peter D. Jelf, both of Orlando, FL (US)

(73) Assignee: Universal City Studios, Inc., Universal City, CA (US)

( * ) Notice: Under 35 U.S.C. 154(b), the term of this patent shall be extended for 0 days.

(21) Appl. No.: 09/295,719

(22) Filed: Apr. 21, 1999

(51) Int. Cl.[7] ..... A63G 31/00

(52) U.S. Cl. ..... 104/53; 104/60; 318/66; 318/445; 701/19

(58) Field of Search ..... 104/53, 60; 318/66, 318/560, 568.16, 580, 586, 587, 364, 445, 452, 484; 472/3; 701/19, 20

(56) References Cited

U.S. PATENT DOCUMENTS

| | | | | |
|---|---|---|---|---|
| 750,242 | | 1/1904 | Jackman . | |
| 937,456 | | 10/1909 | Miller . | |
| 997,071 | | 7/1911 | Mangels . | |
| 1,070,082 | | 8/1913 | Thompson . | |
| 1,079,052 | | 11/1913 | Ingersoll . | |
| 1,102,821 | | 7/1914 | Thompson . | |
| 1,999,052 | | 4/1935 | Kennedy . | |
| 3,830,161 | | 8/1974 | Bacon | 104/70 |
| 4,904,910 | * | 2/1990 | Hsu | 318/445 |
| 5,463,962 | * | 11/1995 | Gnezdilov | 104/53 |
| 6,060,847 | * | 5/2000 | Hettema et al. | 318/66 |

OTHER PUBLICATIONS

"Lightning Racer" racing/dueling roller coaster—Hershey Park Website: www.HersheyPA.com/attractions/hershey-park/rides/hp_ltracer.html—Class 104/53—Aug. 1, 2000.*

"Gwazi" racing roller coaster—Busch Gardens Website: www.buschgardens.com/press/bgtb/gwazi.html Class 104/53—Aug. 1, 1990.*

* cited by examiner

*Primary Examiner*—S. Joseph Morano
*Assistant Examiner*—Lars A. Olson
(74) *Attorney, Agent, or Firm*—Lyon & Lyon LLP

(57) ABSTRACT

A dueling or racing roller coaster ride has tracks which approach or cross over each other at near miss locations. A controller system controls the timing of launch of a roller coaster vehicle on each track to better achieve consistent simultaneous arrival of the roller coaster vehicles at the near miss locations, to provide increased thrills and excitement to the riders. The control system determines the loaded vehicle weight via current draw on the track side vehicle motors. The control system generates a vehicle performance parameter, based on past vehicle speed over the track, to compensate for roller resistance and aerodynamic factors. The vehicle weight information and performance parameters are used to determine which vehicle to launch first, and the amount of delay between launching the vehicle on the first track and launching the vehicle on the second track, to better achieve simultaneous arrival at one or more locations.

20 Claims, 7 Drawing Sheets

ROLLER COASTER CONTROL SYSTEM

FIELD OF THE INVENTION

The field of the invention is roller coasters and similar amusement rides.

BACKGROUND OF THE INVENTION

Roller coasters have long been some of the most well liked rides at amusement parks. Roller coasters normally have an endless track loop. Riders load and unload at a platform or station, typically at a low elevation. At the beginning of each ride cycle, a roller coaster car or a train of cars, is generally towed or moved up a relatively steep incline of an initial track section to the highest point on the entire track. The car is then released from the high point and gains kinetic energy, which allows the car to travel entirely around the track circuit or loop, and return back to the loading/unloading station. The roller coast track typically includes various loops, turns, inversions, corkscrews and other configurations intended to thrill the riders.

Racing or dueling rolling coasters typically have two side by side endless track loops, with the tracks parallel to each other. In this way, a roller coaster train on the first track can "race" with a roller coaster train on the second track. This well known "racing" feature provides added thrills and excitement for the riders. Generally, the roller coaster trains and tracks in dueling or racing coasters are made to be nearly as equivalent as possible, to provide for more competitive "racing". If one coaster train or track is consistently faster than the other, the racing coasters will increasingly be spaced farther and farther apart, as they progress over the track, and the sensation of racing will be lost.

In the operation of racing coasters, each coaster is towed on its track to side by side high points. The coasters are then launched or released simultaneously. As the coasters are propelled purely via gravity, the coasters will be evenly matched only if the coaster speed related variables (such as coaster payload, coaster wheel bearing efficiency, coaster wheel concentricity, wind resistance, coaster tire to track resistance, etc.) are comparable. If the combinations of these variables are comparable, then the racing coasters will be evenly matched, and will travel at the same speed over their tracks. However, these combinations of variables will more often than not result in one coaster train being significantly faster than the other, thereby undesirably reducing the advantages of racing coasters. Consequently, some of the excitement and thrills intended in the design of the racing roller coasters is often lost due to these types of variables.

Accordingly, it is an object of the invention to provide an improved racing roller coaster. Other objects and advantages will appear hereinafter.

SUMMARY OF THE INVENTION

To these ends, in a first aspect of the invention, a roller coaster or other amusement ride has a first vehicle movable along a first track or path and a second vehicle movable along a second track or path. The vehicle may be an individual vehicle or train of connected vehicles. Vehicle lifting or towing systems tow the vehicles to high points on the tracks or paths. A control system controls the lifters to delay the release of the expected faster vehicle, so that the vehicles will be more evenly matched as they move over the tracks. Preferably, the controller determines which vehicle to release first, and determines the amount of delay between release of the first and second vehicles, based on the loaded weights of the vehicles, and/or on individual vehicle speed performance on prior runs over the first and second tracks. The vehicles may be steered or guided by the tracks or via other techniques on a path.

In a second and separate aspect of the invention, the loaded weights of the vehicles or trains are determined by measuring current draw of motors used to drive the lifting systems.

In a third and separate aspect of the invention, the time intervals for individual vehicles to reach selected track locations are measured and used to update the vehicle performance parameters.

In a fourth and separate aspect of the invention, multiple trains operate on each track, and a performance curve is determined and used for each individual train.

In a fifth and separate aspect of the invention, a roller coaster or other amusement ride has a first vehicle movable along a first path and a second vehicle movable along a second path. A first vehicle propulsion system accelerates the first vehicle to a first speed and a second vehicle propulsion system accelerates the second vehicle to a second speed. A controller controls the propulsion systems to adjust the first and second speeds, based on vehicle weight and/or a vehicle performance parameter.

In a sixth aspect of the invention, the first and second propulsion systems accelerate the first and second vehicles to equivalent speeds, and provide different release times for the first and second vehicles by engaging the vehicles, or by starting the vehicles movements, at different times.

BRIEF DESCRIPTION OF THE DRAWINGS

Other objects and features of the invention will become apparent from the following detailed description taken in connection with the accompanying drawings. It should be understood, however, that the drawings are intended for the purpose of illustration only, and are not to be taken as a definition of the limits of the invention.

In the drawings, wherein the same reference number denotes the same element throughout all of the views.

DETAILED DESCRIPTION OF THE DRAWINGS

Figure 1:
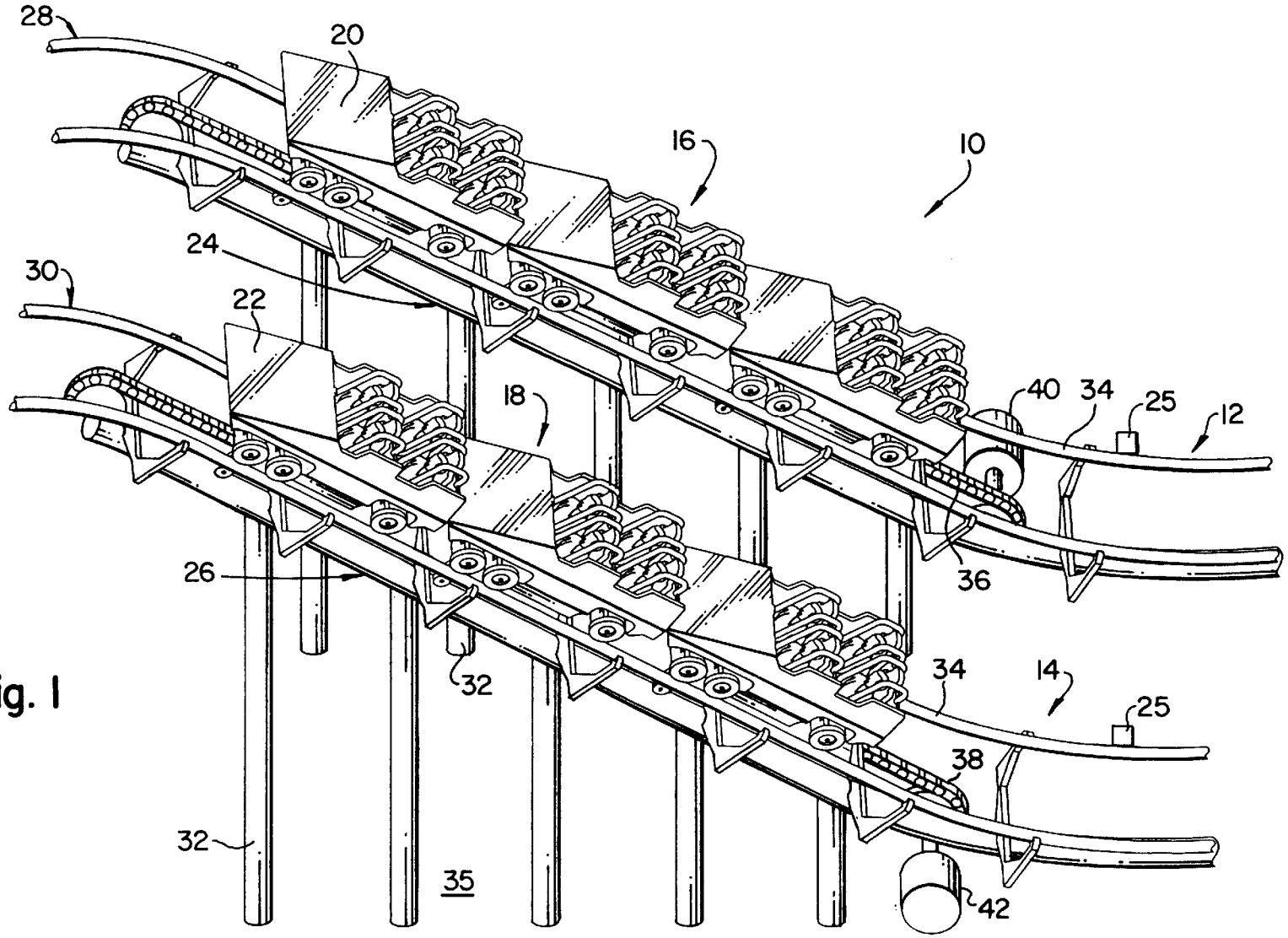
FIG. 1 is a perspective view of the track incline section of a racing roller coaster according to the invention.
Figure 2:
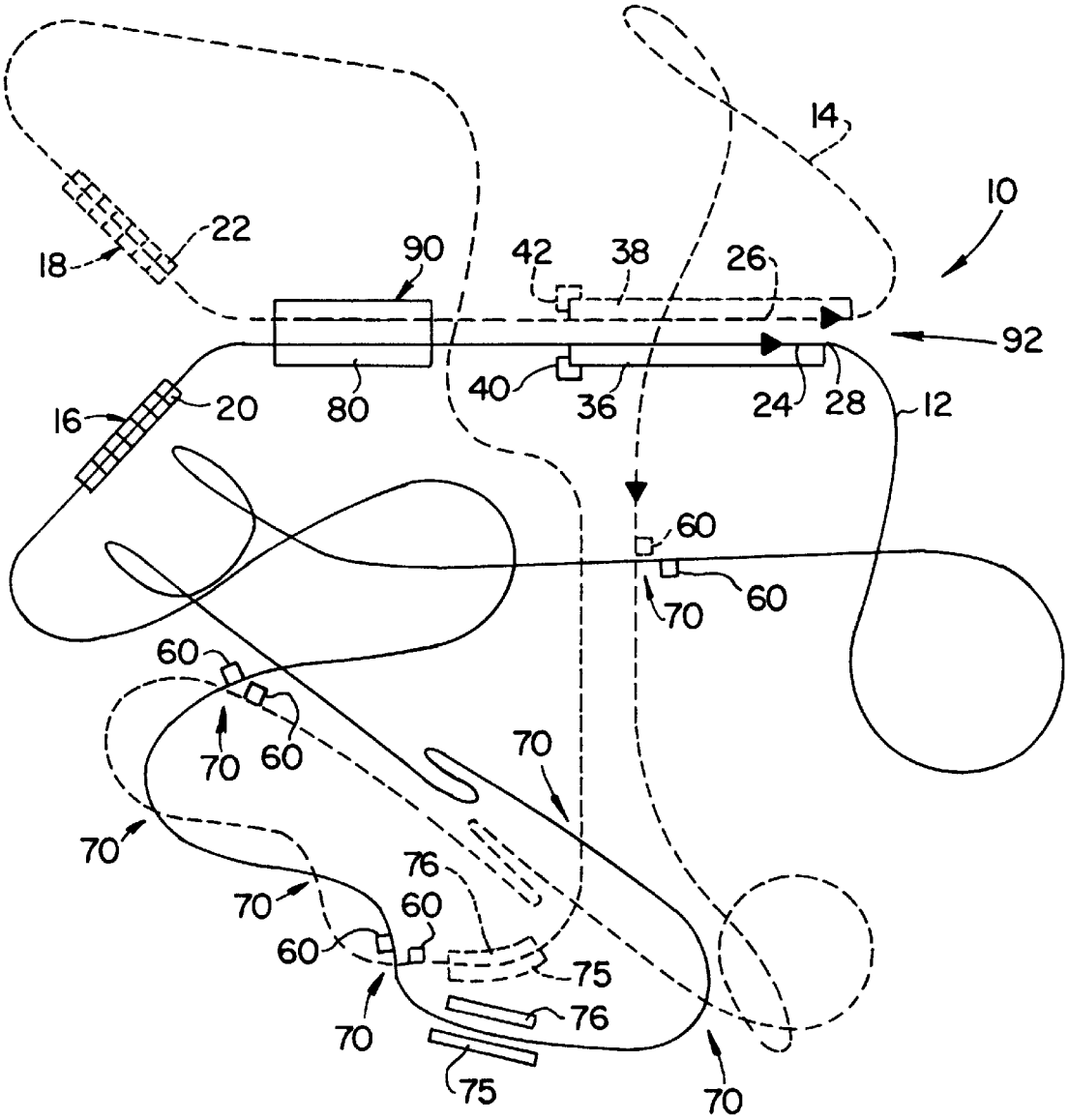
FIG. 2 is a plan view of the track layout of the present racing roller coaster.

Turning now in detail to the drawings, as shown in FIG. 1, a racing coaster amusement ride 10 has a first track 12 and a second track 14. A first train of vehicles 20 rides on the track rails 34 of the first track 12. Similarly, a second train 18 including vehicles 22 rides on the track rails 34 of the second track 14. The vehicles 20 and 22 and tracks 12 and 14 may be structurally and functionally the same (although the track paths are different, as shown in FIG. 2). Structural supports 32 extend up from the ground 35 to support the tracks 12 and 14 at the desired positions and elevations.

Figure 7:
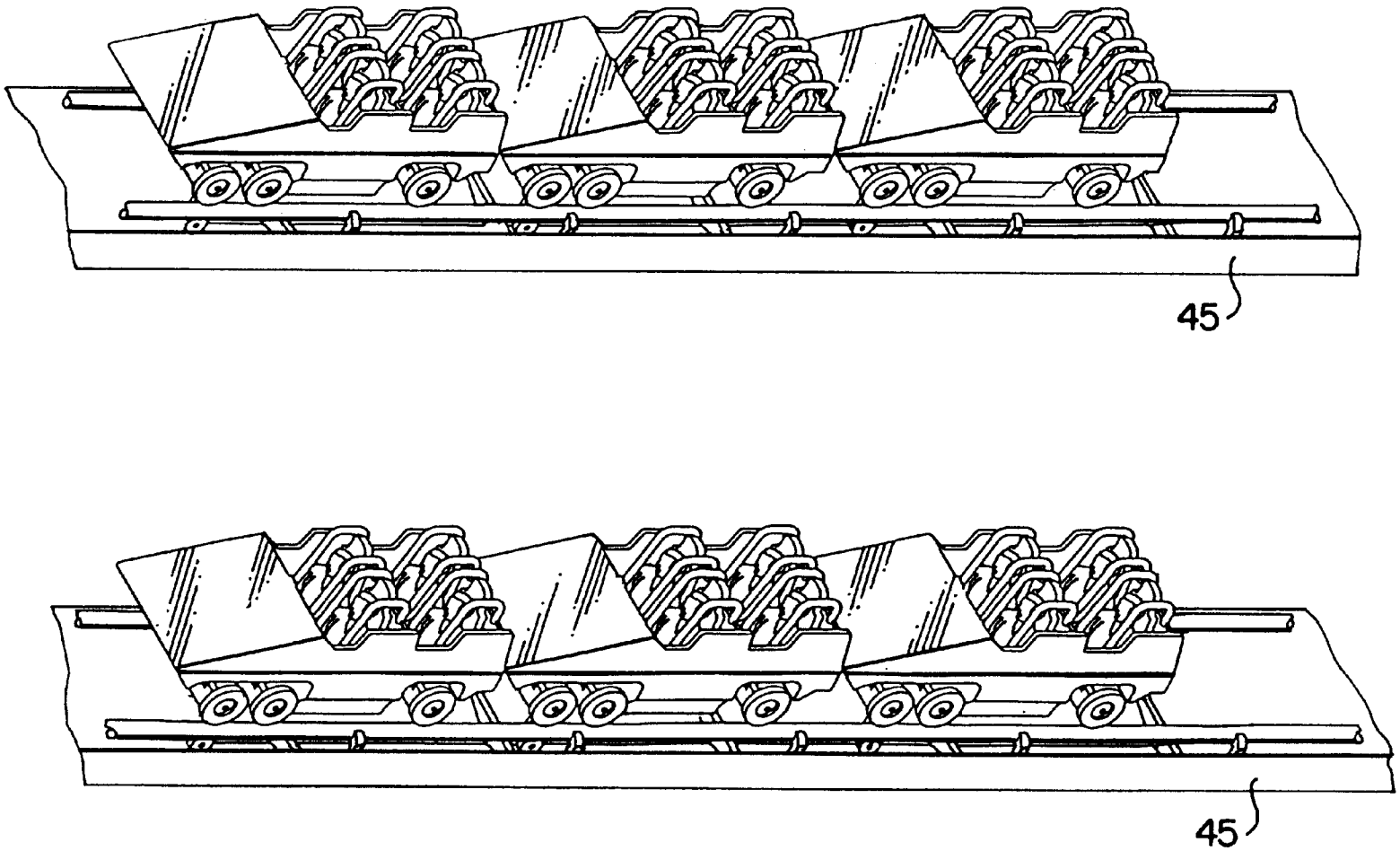
FIG. 7 is a perspective view of an alternative embodiment having a propulsion system.

Referring still to FIG. 1, both tracks 12 and 14 have initial launch or incline sections 24 and 26, with the tracks running uphill to high points 28 and 30. A vehicle towing or lifting drive system 36 and 38 is provided on each of the inclines 24 and 26, respectively. The lift systems 36 and 38 include electric drive motors 40 and 42, driving a chain loop which engages a towing hook or dog on the bottom of the vehicles 20 and 22, to tow or lift the vehicles up the incline, as is well known in the roller coaster industry. Alternatively, the lift systems, may be replaced with linear induction motors (LIMs) or linear synchronous motors (LSMs) or other types of motors 45 which accelerate the vehicles to a desired speed, as shown in FIG. 7. If these types of motors are used, the vehicles are provided with initial kinetic energy, rather than with potential energy in the embodiment having the vehicles towed up to a peak. Hence, no initial lift or incline is needed.

Referring now to FIG. 2, the first and second tracks 12 and 14 have parallel track sections 90 where the tracks 12 and 14 run parallel and next to each other. The tracks 12 and 14 also extend away from each other, and at various angles to each other, in three dimensions, throughout the amusement ride 10, at various divergent track sections 92. Accordingly, although the amusement ride 10 provides racing coasters, the tracks 12 and 14 are not uniformly parallel to and alongside each other. Rather, the tracks 12 and 14 are parallel and close to each other at certain parallel track sections 90, and cross over, under, or approach each other at several other "near miss" locations 70. As the tracks do not physically intersect each other, there is no risk of collision between the trains or vehicles on the two different tracks. However, at the near locations 70 if the cars arrive simultaneously, the riders perceive a near miss event or potential collision, as the tracks cross over each other or come near each other (although they are vertically or horizontally separated at the near miss locations 70). While the track paths are made up largely of divergent track sections 92, the lengths, elevation changes, and track geometries are set up so that trains will arrive simultaneously at at least one near miss location, if all of the train speed variables are equal or balanced between both of the trains. Preferably, the trains will arrive simultaneously at several near miss locations.

A load/unload station or platform 80 is provided at the parallel track section 90 in front of the incline sections 24 and 26.

Figure 3:
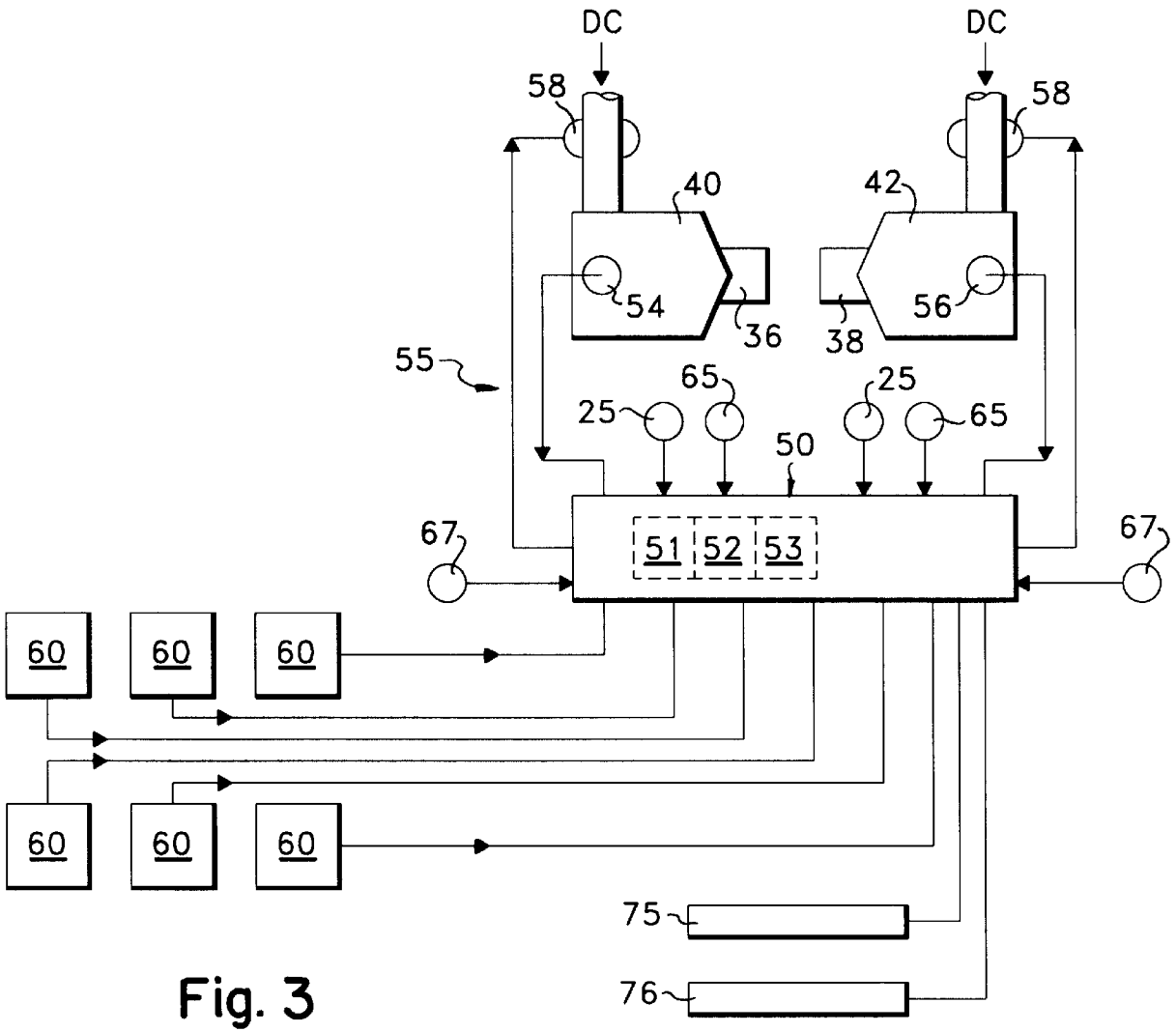
FIG. 3 is a schematic illustration of the control system for the racing roller coaster shown in FIGS. 1 and 2.

Turning to FIG. 3, track sensors 60 are located on both tracks 12 and 14 at or near the near miss locations 70. The track sensors 60 are linked to a controller 50 (via cable, RF, or other communication link) in the ride control system 55. Current sensors 54 and 56 are also linked to the controller 50 and detect the current drawn by the motors 40 and 42. The motors 40 and 42 drive the lift systems 36 and 38. The controller 50 is linked to DC drive controllers 58 which directly control the motors 40 and 42. The controller 50 includes a processor 51, a memory 52 and a clock 53. The controller 50, lift systems 36 and 38 and the various sensors described herein form the ride control system 55.

As is well known in the roller coaster industry, as the trains or vehicles have no motor, they move purely via gravity. Accordingly, after they are released from the high points on the tracks or accelerated by LIMs, the speed of the vehicles cannot be actively controlled. With single track roller coasters, small speed variations are inconsequential. However, with racing or dual track roller coasters, small speed variations between the two tracks is undesirable as the near miss events are degraded or lost, as the vehicles or trains arrive at the near miss locations at different times. If the pair of tracks for a racing coaster are properly designed, the near miss events can only be consistently achieved, if the vehicles on each track have the same rolling resistance, weight, and aerodynamics. However, if one vehicle is more heavily loaded, or if the aerodynamics or rolling resistances are different, then one vehicle will travel faster or slower over its track and arrive at the near miss locations before or after a vehicle on the other track.

The invention shown in FIGS. 1–3 provides a way for compensating for variables in weight, rolling resistance and aerodynamics, so that near miss events are more consistently achieved, for both incline based and propulsion (e.g., LIM based rides.)

In use, riders board the trains 16 and 18 at the platform 80. The controller 50 controls the motors 40 and 42 to pull or drive the trains up the inclines 24 and 26. As this occurs, the current sensors 54 and 56 sense the current drawn by each motor and provide the current draw information to the controller 50. As the loaded weight of each train 16 and 18 is directly proportional to the power required to pull the train up the incline, the current draw information, provided by the current sensors 54 and 56 to the controller, provides information to the controller 50 on the loaded weight of each train 16 and 18. The controller 50 compensates by controlling the motor 40 or 42 lifting the heavier train by a calculated amount. As a result, at the top of the lift, the trains will be spaced apart, and the lighter train or the train that has higher rolling resistance will be launched or released first, providing a head start.

The processor 51 within the controller 50 determines the head start provided to the lighter train. The amount of the head start, or the duration of the delay between launching the first and second trains, is preferably selected so that the faster train will "catch up" to the slower train, at a selected near miss location. While the lighter train will be "ahead" of the heavier train before the selected near miss location, and "behind" the heavier after the selected near miss location, the difference in arrival times at the near miss locations 70 are minimized. The "head start" is provided by controlling the speed of the lifts and/or the difference in release times. Lift speed and train position on the lift are detected by sensors 67, shown in FIG. 3. If LIMs are used, the head start may also be achieved by providing the slower vehicle with a higher launch speed.

Other factors besides weight influence the speed of the trains 16 and 18. These factors include rolling resistance, which includes such subfactors as bearing conditions, wheel eccentricities, track geometry and condition, wheel/track alignment, tire to track friction, condition of tires, condition of track surface, etc. Aerodynamics of the vehicles 20, 22 or the trains 16, 18 also effects speed. To compensate for these variables, the controller 50 develops a train performance curve which is used together with the train weight information to determine which train is expected to run slower, and the amount of head start to be provided to that slower train, so that both trains will more consistently arrive at one or more of the near miss locations 70 simultaneously. The performance parameter is a trend value, based on multiple runs, of the trains speed over the track independent of the trains loaded weight.

Figure 4:
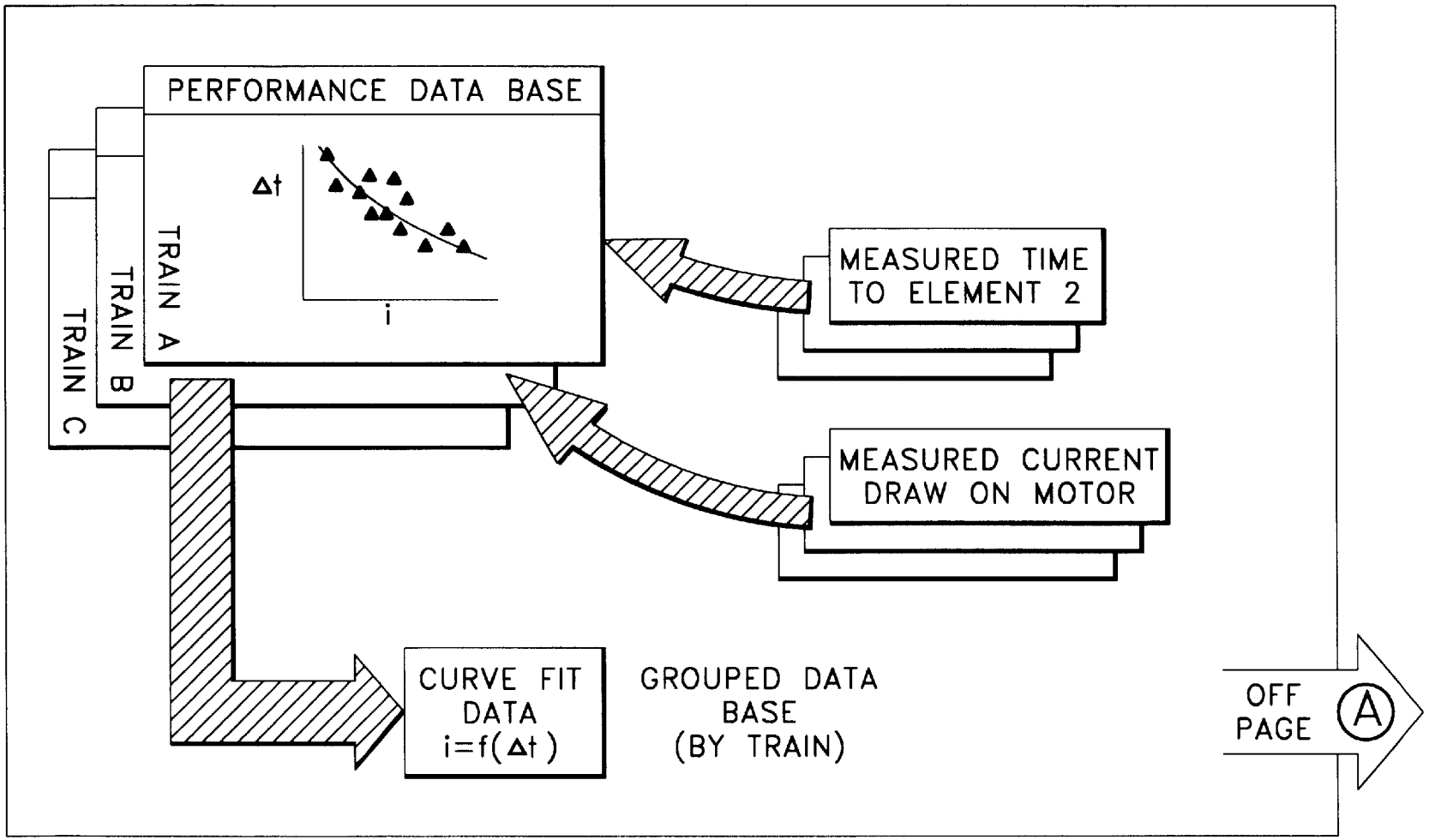
FIG. 4 is a flow chart of vehicle performance parameter data base development.

FIG. 4 shows development of the performance parameter data base. Points are plotted for each train based on measured current draw (1) on the lift (x-axis) and measured elapsed time ($\nabla t$) to complete the run (y-axis). A performance plot or curve is fit to the points. Each train has its own performance curve. The curves form the performance database.

To generate an initial performance curve, preferably, at the beginning of daily operations, the unloaded trains 16 and 18 are launched and travel over the tracks 12 and 14, respectively. The launch time of each train is detected by launch detectors 65, which provide launch signals to 20 the controller 50. The arrival of each train 16 and 18 back at or near the station is detected by track sensors 60. The track sensors 60 provide train arrival signals to the controller 50, which determines the elapsed times ($\Delta t$) for each of the trains 16 and 18. Using this information, the controller 50 determines which train is faster. The trains 16 and 18 are preferably cycled several times over the tracks 12 and 14, with the timing data for each train collected to provide an adequate number of points to fit a curve. The performance curves are stored in the memory 53.

Alternatively, the unloaded runs can be skipped and the performance curves can be generated during actual use with the trains loaded with riders. However, the advantages of using the performance curves will not be realized in the initial run.

After performance curves have been generated, the ride 10 is ready for preferred use. Riders board the trains. Train tag sensors 25 linked to the controller 50 uniquely identify the trains on the lifts. The loaded weight of each train 16 and 18 is determined, as described above. The weight information, and performance curve, for each train, are then input as variables into the controller which calculates how much of a head start is to be provided to the slower train. The controller 50 preferably then slows the motor 40 or 42 lifting the faster train, or speeds up the motor lifting the slower train so that the slower train is launched first. This can also be done with constant speed motors that simply use a different release time. Consequently, the variables influencing train speed are compensated for using real time train weight data, from the current sensors 54 and 56, combined with the past performance data, in the form of a performance curve.

Figure 5:
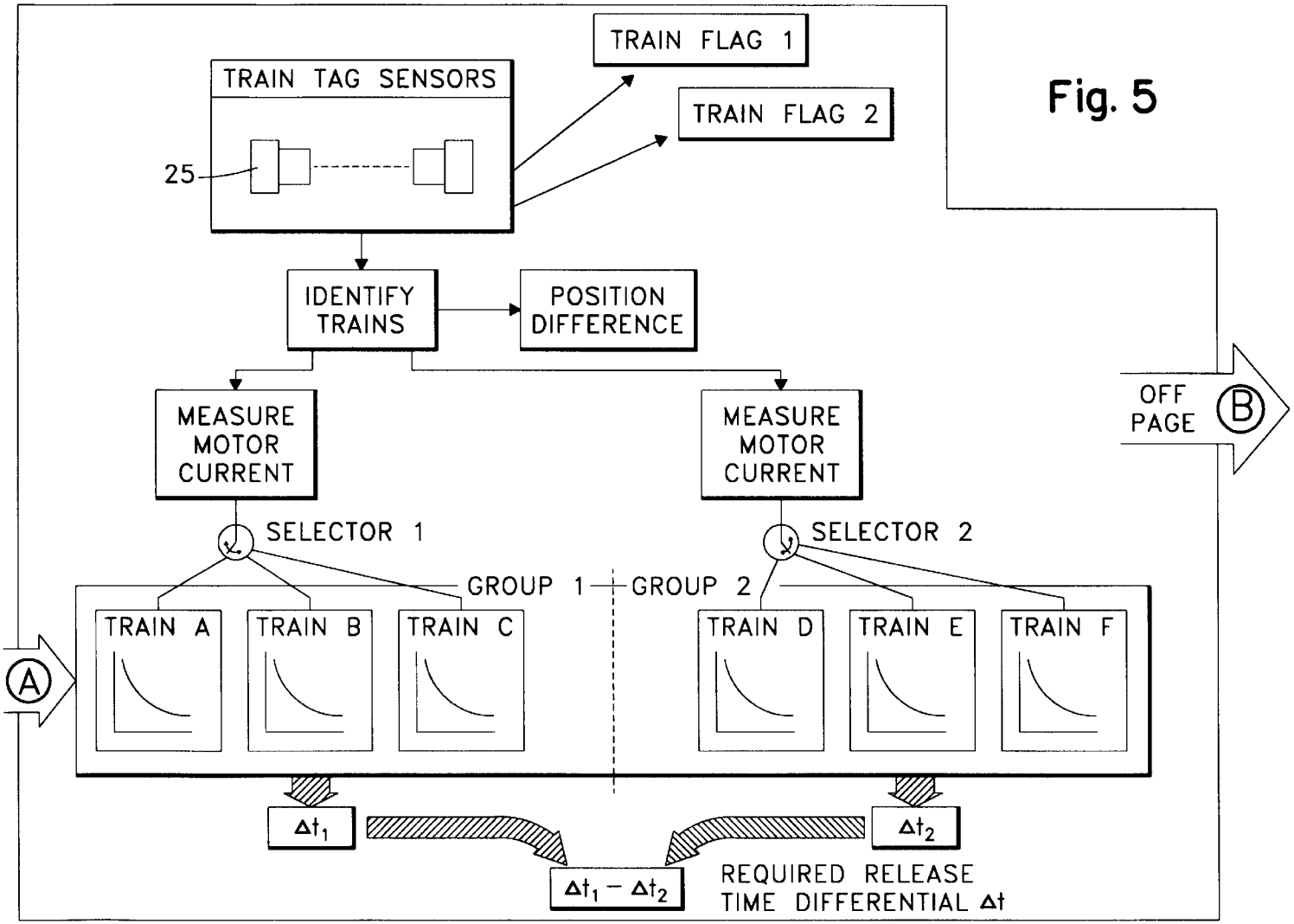
FIG. 5 is a schematic diagram of relative release point determination.

Turning to FIG. 5, the release or launch point determination is shown in further detail. The train tag sensors 25 identify the trains on the lifts 36 to the controller 50. The current draws for those trains are measured as they are lifted or propelled. The controller selects the performance curve for the identified train from the database. Using the current draw information (which is directly related to weight), and the selected performance curves, values $\Delta t$, and $\Delta t2$ are generated. The value $\Delta t_2$ is subtracted from $\Delta t_i$ to determine the required release time different $\Delta t$.

Figure 6:
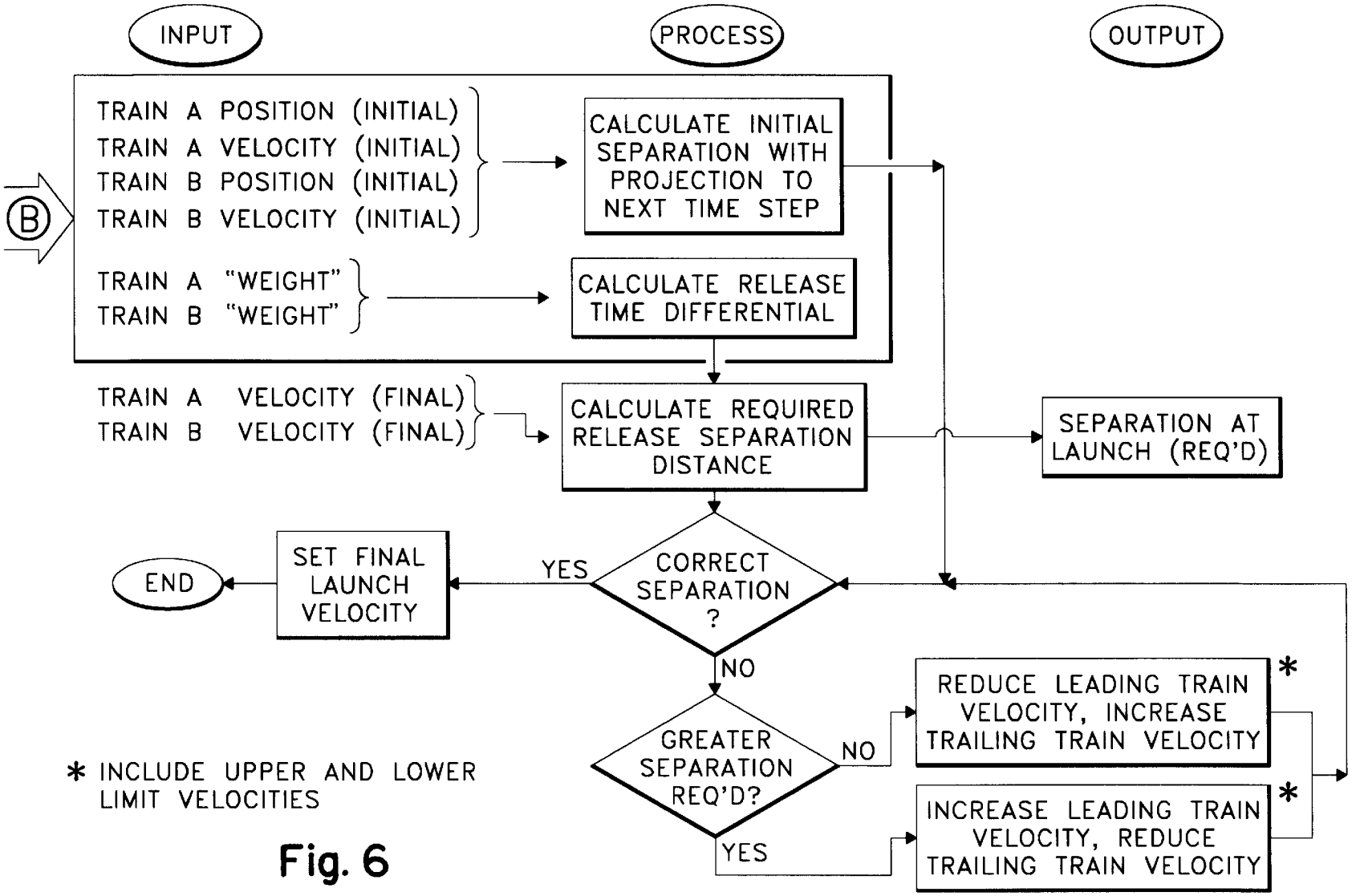
FIG. 6 is a flow chart showing release point determinations.

FIG. 6 shows operation of the control system 55. With the release time difference $\Delta t$ calculated, the controller 50 determines the required separation distance at the track peak, needed to provide the required time differential. The lifts operate continuously. Hence, the trains are constantly moving up on the lifts. As the trains do not stop, the time difference must accordingly be achieved by providing a space separation distance between the competing trains, as they approach the peaks. The separation between the trains on the lifts is monitored. The lift speed is increased or reduced to achieve the calculated separation. Alternatively, the trains are fed into constant speed lifts at different times to get specific separation between trains.

A weighting factor may also be used in steps above, to assign more or less mathematical weight to either the train weight information or the performance parameter information. The mathematical weighting factor, if used, may be selected based on test runs to optimize operation for existing conditions.

As the ride 10 continues to run with riders, the controller 50 continues to monitor vehicle speed over the track, via inputs from the launch detectors 65 and track sensors 60. This information is used to continuously update the performance curves. Consequently, changes in rolling resistance and aerodynamics are continuously compensated for. For example, if the rolling resistance of one of the trains, the rolling speed of that train will be reduced. However, that reduction in speed will be detected by the controller. As a result, on the next run for that train, the controller will provide a compensating head start, so that the near miss events are more consistently maintained.

The amusement ride 10 can be used to compensate for payload or weight differences, separately and apart from the train performance parameters. That is, compensation can be performed using either only weight as a factor, or using only past train performance as a factor. However, preferably, both weight and train performance parameters are used.

The amusement ride 10 contemplates having multiple trains 16 and 18 operate on each track 12 and 14. With this type of operation, a performance curve is developed for each train.

As the trains 16 and 18 have no on board motors or brakes, the speed of the trains cannot be adjusted after they are launched. If the near miss locations 70 are spaced apart around the tracks 12 and 14, the staggered launch timing for the trains can be optimized for only a single (typically centrally located) near miss location. In most embodiments, this compensation will be sufficient. However, for embodiments having longer tracks with near miss locations 70 spaced far apart, mid-track trim braking systems 75 or speed boosting systems 76 (such as LIMS) can be provided. These systems 75 and 76 are linked to and controlled by the controller 50, to optimize simultaneous arrival of both trains at multiple near miss locations.

The two different paths or track systems 12 and 14 are designed to have separate vehicles 16 and 18 "meet" at multiple points throughout the ride for near-miss events, assuming weight and train performance is constant. To have the near-miss events, the track layouts have to be different (if the track layouts were identical, the two trains would always be side by side and there would be no near-miss events). With the track layouts selected and constructed, the differences in train weight, train performance, etc. are determined and compensated for, to insure that the near-miss events actually occur.

Thus, a novel amusement ride has been shown and described. Various modifications may of course be made, and various substitutions of equivalents may be used, without departing from the spirit and scope of the invention. The invention, therefore, should not be restricted, except to the following claims are their equivalents.

What is claimed:

1. An amusement ride comprising:

a first track having a first track launch incline;

a second track adjacent to the first track at at least a first location, the second track having a second track launch incline;

a first vehicle movable along the first track;

a second vehicle movable along the second track;

a first vehicle lifter for moving the first vehicle up on the first track launch incline;

a second vehicle lifter for moving the second vehicle up on the second track launch incline; and a controller linked to and controlling the first and second vehicle lifters, the controller having means for adjusting launching of the first vehicle relative to the second vehicle, based on at least one of vehicle weight, and vehicle performance on prior runs over the first and second tracks.

2. The amusement ride of claim 1 further comprising sensors at different locations along the first and second tracks, for detecting a passing vehicle, with the sensors linked to the controller.

3. The amusement ride of claim 1 wherein the first track crosses over or under the second track at the first location, to form a first near miss event location.

4. The amusement ride of claim 1 wherein the first and second vehicle lifters comprise first and second electric motors, and further comprising current sensors for sensing the current draw of each motor, with the current sensors linked to the controller.

5. The amusement ride of claim 4 further comprising means for converting a sensed current draw measurement into a loaded vehicle weight value.

6. The amusement ride of claim 1 further comprising means for determining a time delay between launch of the first vehicle and the second vehicle, based on input variables including at least loaded vehicle weight and prior vehicle performance.

7. The amusement ride of claim 1 further comprising a plurality of near miss locations where the first and second tracks are adjacent to or cross each other, and a vehicle sensor associated with each track at each near miss location, with the vehicle sensors linked to the controller.

8. The amusement ride of claim 1 further comprising a memory linked to the controller for storing data on vehicle performance.

9. The amusement ride of claim 1 wherein the first track is spaced apart from the second track, except at a plurality of near miss locations and a plurality of parallel track sections.

10. The amusement ride of claim 1 wherein the vehicles move over the tracks driven via gravity.

11. A method for operating a roller coaster ride having a first vehicle on a first track and a second vehicle on a second track, comprising the steps of:

determining the loaded weight of first vehicle and the second vehicle;

determining a vehicle performance curve for the first and second vehicles, based on a measured performance characteristic of each vehicle in prior runs of the first and second vehicles on the first and second tracks;

determining a second vehicle launch delay time, based on the loaded weights and performance parameters of the vehicles;

launching the first vehicle on the first track;

waiting until the second vehicle release delay time has elapsed; and launching the second vehicle on the second track.

12. The method of claim 11 further comprising the step of determining the loaded weight of each vehicle by measuring current draw in electric motors adapted to drive the vehicles up an incline on the first and second tracks.

13. The method of claim 11 further comprising the step of monitoring vehicle performance to continuously update the vehicle performance parameters.

14. The method of claim 11 further comprising the steps of:

measuring the elapsed time between the launch of the first vehicle, and the arrival of the first vehicle at a first sensor location of the first track, and measuring the elapsed time between the launch of the second vehicle and the arrival of the second vehicle at a second sensor location of the second track, comparing the elapsed times; and adjusting the vehicle performance parameter based on the comparison of the elapsed times.

15. The method of claim 11 wherein the vehicles have no on-board motor and move on the tracks only via gravity.

16. A method for operating a roller coaster ride having a first vehicle on a first track and a second vehicle on a second track, comprising the steps of:

determining the loaded weight of first vehicle and the second vehicle;

determining a second vehicle launch delay time, based on the loaded weights of the vehicles;

launching the first vehicle on the first track;

waiting until the second vehicle release delay time has elapsed; and launching the second vehicle on the second track.

17. An amusement ride comprising:

a first path;

a second path;

a first vehicle movable along the first path;

a second vehicle movable along the second path;

a first propulsion system associated with movement along the first path;

a second propulsion system associated with movement along the second path; and a controller linked to and controlling the first and second propulsion systems to adjust a launch parameter of the first and second vehicles provided by the first and second propulsion systems, to compensate speed performance differences between the vehicles as they move over the first and second paths, respectively.

18. The amusement ride of claim 17 wherein the first and second propulsion systems are located alongside the first and second paths, respectively.

19. The amusement ride of claim 18 wherein the first and second propulsion systems comprise linear induction motors.

20. The amusement ride of claim 17 wherein the launch parameter is launch timing or launch speed.

* * * * *